US006860492B2

(12) United States Patent
Balconi et al.

(10) Patent No.: US 6,860,492 B2
(45) Date of Patent: Mar. 1, 2005

(54) GLIDING DEVICE

(75) Inventors: Claudio Balconi, Casier (IT); Mario Poloni, Trevignano (IT)

(73) Assignee: Benetton Group S.p.A., Ponzano Veneto (IT)

( * ) Notice: Subject to any disclaimer, the term of this patent is extended or adjusted under 35 U.S.C. 154(b) by 51 days.

(21) Appl. No.: 10/333,016

(22) PCT Filed: May 29, 2002

(86) PCT No.: PCT/EP02/05927

§ 371 (c)(1),
(2), (4) Date: Jan. 15, 2003

(87) PCT Pub. No.: WO02/096231

PCT Pub. Date: Dec. 5, 2002

(65) Prior Publication Data

US 2003/0151213 A1 Aug. 14, 2003

(30) Foreign Application Priority Data

May 31, 2001 (IT) ..... TV20010034 U

(51) Int. Cl.[7] ..... A63C 17/04

(52) U.S. Cl. ..... 280/11.221; 280/11.231; 280/11.225; 36/115

(58) Field of Search ..... 280/11.19, 11.221, 280/11.223, 11.225, 11.3, 11.27; 36/115, 116

(56) References Cited

U.S. PATENT DOCUMENTS

| | | | | | |
|---|---|---|---|---|---|
| 4,351,537 | A | * | 9/1982 | Seidel | 280/11.12 |
| 4,385,456 | A | * | 5/1983 | Livernois et al. | 36/115 |
| 5,528,841 | A | * | 6/1996 | Pozzobon | 36/3 A |
| 5,768,807 | A | * | 6/1998 | Caeran et al. | 36/115 |
| 6,006,450 | A | * | 12/1999 | Hayes | 36/107 |
| 6,029,983 | A | * | 2/2000 | Wegener | 280/11.231 |
| 6,079,128 | A | * | 6/2000 | Hoshizaki et al. | 36/89 |
| 6,102,412 | A | * | 8/2000 | Staffaroni | 280/11.225 |
| 6,164,669 | A | * | 12/2000 | Svensson | 280/11.3 |
| 6,340,164 | B1 | * | 1/2002 | Borel | 280/11.225 |
| 6,371,494 | B1 | * | 4/2002 | Bonaventure et al. | 280/11.19 |
| 6,517,090 | B1 | * | 2/2003 | Fullum | 280/11.221 |

FOREIGN PATENT DOCUMENTS

| | | |
|---|---|---|
| EP | A-0 085 133 | 8/1983 |
| EP | A-1 036 513 | 9/2000 |

* cited by examiner

*Primary Examiner*—Christopher P. Ellis
*Assistant Examiner*—Brian Swenson
(74) *Attorney, Agent, or Firm*—Guido Modiano; Albert Josif; Daniel O'Byrne

(57) ABSTRACT

An in-line skate having a sports shoe connected to a frame supporting a plurality of in-line wheels. The sports shoe has a sole, and an upper made of soft material, and rigid protection strips. The protections strips are arranged above the lateral edge of the sole: at the lateral metatarsus region of the foot of the user; at the lateral heel region of the user's foot; and at the anklebone region of the user's foot.

7 Claims, 2 Drawing Sheets

GLIDING DEVICE

BACKGROUND OF THE INVENTION

The present invention relates to an improved gliding device, particularly suitable for the practice of so-called "aggressive" gliding sports.

Today, "aggressive" gliding sports are quite widespread. Basically, this kind of sports practice consists of a series of acrobatics movements. For example, with reference to the field of skating, the term "aggressive skating" means a number of certain acrobatic activities, such as the so-called "grinding" (i.e. a crosswise passage along kerbs or handrails) or other stunt movements.

Known gliding devices generally comprise a gliding member, to which a sports shoe is associated. Again with reference to the field of skating, such gliding member generally comprises a frame, which supports a plurality of in-line wheels. The sports shoe of the gliding device typically comprises a rigid sole and an upper. The upper generally includes a shell and a cuff, which surround an internal liner for accommodating the foot of the user. The shell and the cuff are fitted with a pair of opposing flaps that may be fastened together through suitable fastening buckles arranged transversely to such flaps. The gliding device generally comprises also means for protecting the foot and the lower portion of the user's leg from the frequent impacts and other accidental events, to which the gliding device is subjected during the sports practice. For example, in skating, such accidental events may be represented by sudden contacts against steps, platforms, railings, pavements and the like. Generally, the rigid walls of the shell and/or of the cuff, generally made of plastics, provide such protection means. In this manner, the shell and/or the cuff are sturdy and ensure a suitable protection to the user.

However, conventional gliding devices suffer some drawbacks.

A first shortcoming consists in that the walls of the shell and/or of the cuff are relatively thick, since their main function is to ensure protection. This fact entails that the gliding device is often cumbersome, heavy and unattractive from an aesthetic point of view. This problem is worsened by the fact that the acrobatic sports activity causes frequent damage to the outer surface of the gliding device, which thus shortly appears somewhat scratched and ruined. A further problem consists in that the shell and/or the cuff made of plastics do not allow a satisfactory transpiration of the user's foot. This fact, combined with the relatively high sturdiness of the shell, implies that known gliding devices are often uncomfortable and suffer high levels of internal moisture and temperature.

SUMMARY OF THE INVENTION

Thus, the aim of the present invention is to provide a gliding device, particularly suitable for "aggressive" sports practice, which ensures a suitable protection for the foot and the lower portion of the user's leg against impacts and other accidental events and which ensures, at the same time, a relatively high level of comfort for the user, together with a pleasing aesthetic appearance.

Within this aim, an object of the present invention is to provide a gliding device, which has reduced weight and overall size.

Another object of the present invention is to provide a gliding device, which is structurally simple and has low manufacturing costs.

The above aim and objects and others which will become better apparent hereinafter are achieved by a gliding device, which comprises:

a gliding member;

a sports shoe associated to the gliding member; the sports shoe comprising at least a sole, and an upper which extends upwardly of the sole; the upper comprising at least a soft portion, which is made of a soft material; and protection means for protecting the foot and the lower portion of the user's leg against impacts and other accidental events, characterised in that the protection means comprises one or more protection elements, which are rigidly associated at least to the soft portion of the upper.

BRIEF DESCRIPTION OF THE DRAWINGS

Further characteristics and advantages of the gliding device according to the present invention will become better apparent from the following detailed description of a particular embodiment thereof, illustrated by way of nonlimitative example in the accompanying drawings, wherein.

DESCRIPTION OF THE PREFERRED EMBODIMENTS

The gliding device according to the present invention will be described hereinafter with particular reference to its use in "aggressive" skating. This is only for the sake of simplicity and it does not imply any limitation of the scope of the present invention. In fact, the present gliding device can be advantageously used without distinction in many other gliding sports, such as traditional or speed skating, rolling, skiing, snowboarding and the like.

Figure 2:
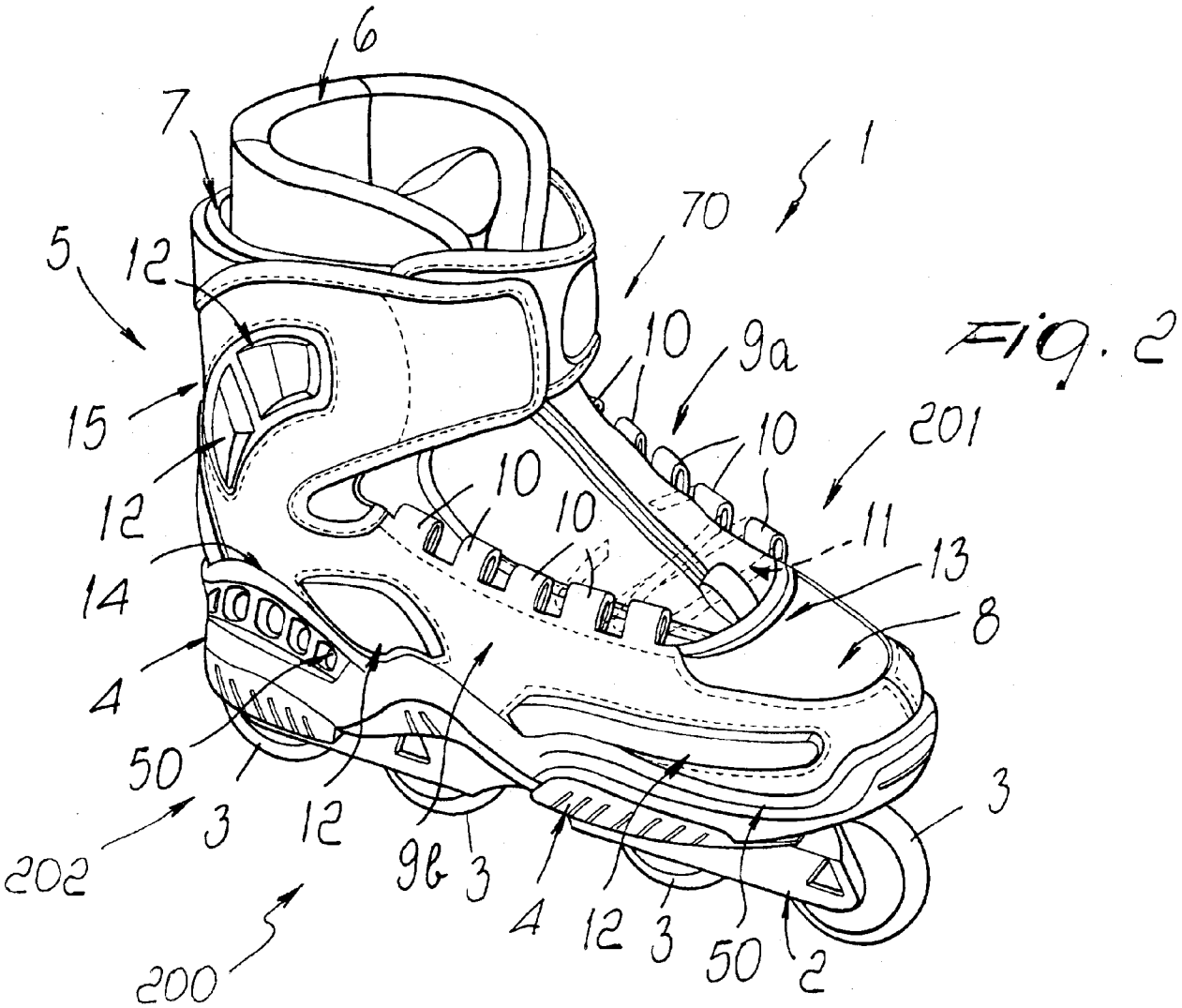
FIG. 2 is another perspective view of the gliding device, shown in FIG. 1.

With reference to the figures, reference numeral 1 designates a skate comprising a gliding member 200, which, in this case, comprises a frame 2 supporting a plurality of wheels 3. A sports shoe 5 is associated to the gliding member 200. The sports shoe 5 comprises at least a rigid sole 4, which is connected to the frame 2, and an upper 8, which extends upwardly of the sole 4. The upper 8 comprises at least a soft portion 70, made of soft material, such as leather, rubber or the like. The sports shoe 5 comprises also protection means for protecting the foot and the lower portion of the user's leg against impacts and other accidental events. Such protection means comprises one or more protection elements such as protection strips 12, which are rigidly associated to the soft portion 70. Particularly, the protection elements 12 are arranged, so as to protrude externally from the soft portion 70. Of course, such protection means may advantageously include also a rigid or semi-rigid shell (not shown) and cuff, reference numeral 7, to allow a satisfactory transmission of the forces to the frame 2. In this case, as illustrated in FIG. 2, the soft portion 70 can be arranged, so as to cover, at least partially, the shell and the cuff 7. Thereby the shell and the cuff may be suitably designed for ensuring a good transmission of forces only and not for having necessarily protection purposes. Therefore, the thickness of the walls of the shell and the cuff 7 can be remarkably reduced and provided with suitable openings to allow a good transpiration of the user's foot, with consequent increase of comfort for the user. Thus, the shell and the cuff 7 may even be reduced to an essential frame structure, provided with few supporting elements and having the sole purpose of transmitting forces to the frame 2.

Preferably, the sports shoe 5 comprises also an inner liner 6, which is accommodated inside the shell and the cuff 7 and which accommodates the foot and the lower portion of the user's leg.

The soft portion 70 comprises a first flap 9*a* and/or a second flap 9*b*, which cover at least partially the internal lateral side 201 and/or the external lateral side 202 of the user's foot, respectively. Flaps 9*a* and 9*b* are arranged opposite to each other and may be fastened together by means a fastening lace 11 that passes through a succession of eyelets 10. Advantageously, the protection elements 12 protrude externally from the first flap 9*a* and/or the second flap 9*b*.

As mentioned above, the protection elements 12 may comprise one or more suitably shaped protection strips, which may advantageously be provided with layers of relatively rigid material with a predefined thickness. Preferably, the protection strips 12 are made of abrasion-proof materials, such as polyurethane.

Figure 1:
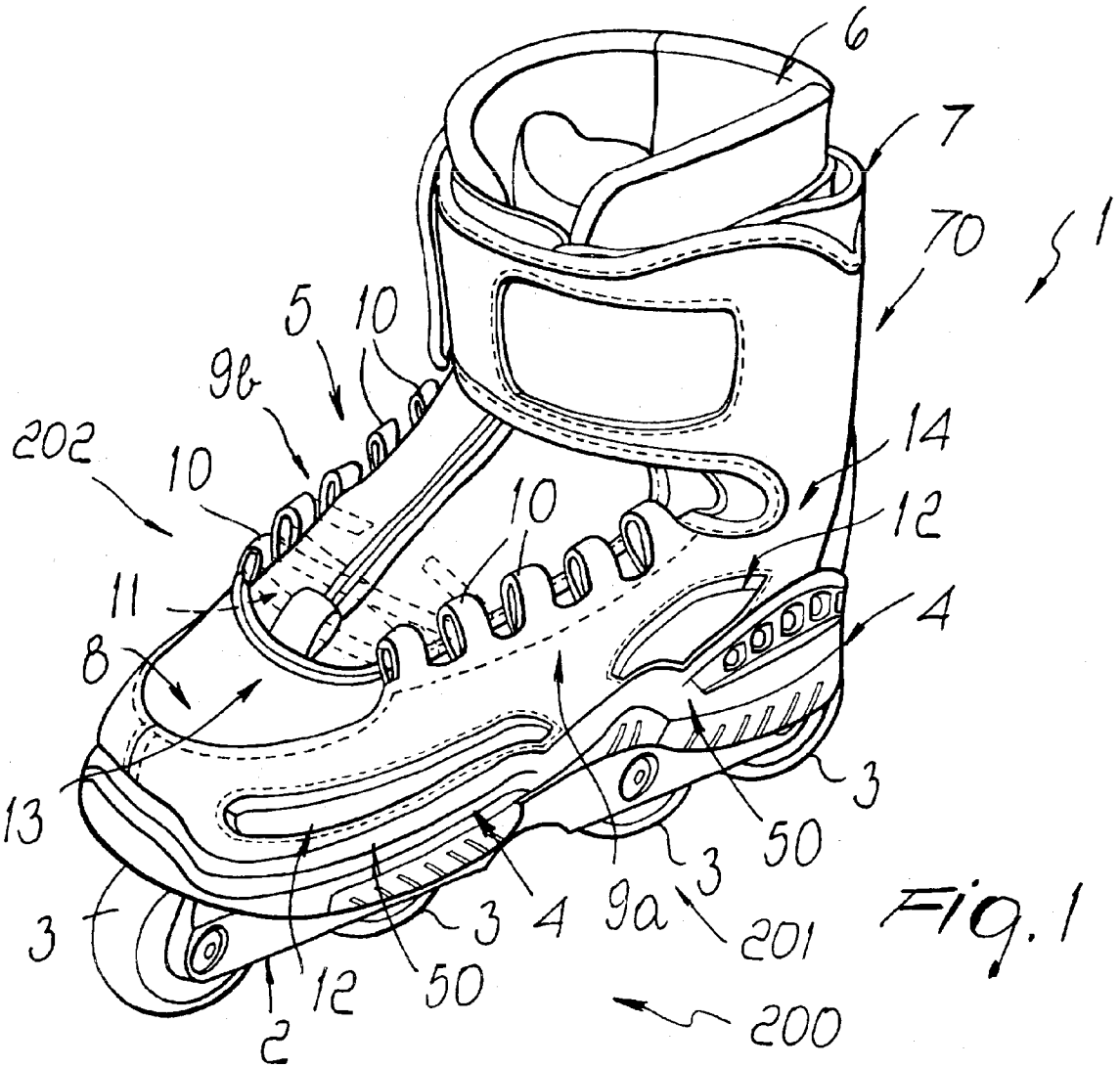
FIG. 1 is a perspective view of the gliding device, according to the present invention.

In this manner, strips 12 are able to ensure a suitable protection in the regions of the foot which have the major probability of suffering from impacts and other accidental events. Preferably, such protection strips 12 are arranged to co-operate with the rigid sole 4 in order to build up an equivalent protection layer, which surrounds externally the upper 8. For example, they can be arranged above the lateral edge 50 of rigid sole 4, approximately at the lateral metatarsus region 13 and/or at the anklebone region 15 and/or at the heel region 14 of the user's foot. Preferably, as illustrated in FIGS. 1 and 2, the protection strips 12 are counter-shaped at the bottom to form an easement with the lateral edge 50 of the rigid sole 4. In this manner, the protection strips 12 are almost the only elements of the soft portion 70, which are involved when an impact occurs. In this manner, the remaining portions of the upper 8 may suffer from a relatively reduced wear, since they are almost totally prevented from direct contact with the ground or any objects that are hit during the sports activity.

It has thus been shown that the gliding device, according to the present invention, achieves the intended aim and objects.

In fact, the soft portion 70 of the upper 8 ensures a suitable protection to the user since it incorporates the protection elements 12. At the same time, a remarkable reduction of the walls of the shell and of the cuff and a satisfactory level of transpiration of the foot of the user are achieved. In this manner, the sports activity can be accomplished with maximum comfort and in total safety, guaranteeing particular protection to the foot regions, which are subject to frequent impact and injury. Further, the protective elements 12 increase remarkably the durability of the soft portion 70 and allow to maintain its aesthetic characteristics for a long time. In fact, the protective elements 12 effectively protect the soft portion 70 against scratches, abrasions and splitting. Thus, the gliding device has always a pleasing and enduring aesthetic impact. Finally, the structural simplicity of the gliding device, according to the present invention; allows to remarkably reduce the manufacturing time and costs.

In practice, the materials employed, so long as they are compatible with the contingent use, as well as the dimensions, may be any according to requirements.

The disclosures in Italian Utility Model Application No. TV2001U000034 from which this application claims priority are incorporated herein by reference.

What is claimed is:

1. A gliding device comprising:

a gliding member;

a sports shoe associated to said gliding member, said sports shoe comprising at least a sole and an upper, which extends upwardly of said sole, said upper comprising at least a soft portion made of soft material;

protection means for protecting the foot and the lower portion of the user's leg against impacts and other accidental events;

wherein said protection means comprises one or more protection elements, which are made of rigid material and which are rigidly associated at least to the soft portion of said upper;

said protection elements comprising one or more shaped protection strips, said one or more of said protection strips being arranged;

above the lateral edge of said sole, approximately at the lateral metatarsus region of the foot of the user;

above the lateral edge of said sole, approximately at the lateral heel region of the user's foot; and above the lateral edge of said sole, approximately at the anklebone region of the user's foot.

2. The gliding device according to claim 1, wherein said protection elements are arranged so as to protrude eternally from the soft portion of said upper.

3. The gliding device according to claim 2, wherein the soft portion of said upper comprises a first flap and/or a second flap, which cover at least partially the internal side and/or the external side of the user's foot, respectively, said protection elements protruding externally at least from said first flap and/or said second flap.

4. The gliding device according to claim 1, wherein said protection strips are provided with a predefined thickness so as to constitute, in co-operation with said sole, a protection layer, which protects externally said upper, at least partially.

5. The gliding device according to claim 1, wherein one or more of said protection strips are counter-shaped at the bottom, so as to co-operate with the lateral edge of said sole and form an easement with the lateral edge of said sole.

6. The gliding device according to claim 1, wherein said protection elements are made of abrasion-resistant materials.

7. The gliding device according to 1, further comprising a shell and cuff made of a material selected from rigid material and semi-rigid material, said shell and cuff being arranged internally of said soft upper such that said soft upper covers said shell and cuff.

* * * * *